US007633456B2

(12) United States Patent
York

(10) Patent No.: US 7,633,456 B2
(45) Date of Patent: Dec. 15, 2009

(54) WAFER SCANNING ANTENNA WITH INTEGRATED TUNABLE DIELECTRIC PHASE SHIFTERS

(75) Inventor: Robert A. York, Santa Barbara, CA (US)

(73) Assignee: Agile RF, Inc., Goleta, CA (US)

( * ) Notice: Subject to any disclaimer, the term of this patent is extended or adjusted under 35 U.S.C. 154(b) by 316 days.

(21) Appl. No.: 11/754,735

(22) Filed: May 29, 2007

(65) Prior Publication Data

US 2007/0279294 A1 Dec. 6, 2007

Related U.S. Application Data

(60) Provisional application No. 60/809,525, filed on May 30, 2006.

(51) Int. Cl.
*H01Q 21/00* (2006.01)

(52) U.S. Cl. ..... 343/853; 343/700 MS; 333/156; 333/161; 342/372

(58) Field of Classification Search ..... 343/700 MS, 343/853; 342/372; 333/156, 161
See application file for complete search history.

(56) References Cited

U.S. PATENT DOCUMENTS 4,885,562 A 12/1989 Ouvrard et al.
4,945,321 A 7/1990 Oppelt et al.
6,559,737 B1 5/2003 Nagra et al.
6,646,522 B1 * 11/2003 Kozyrev et al. ..... 333/161
6,674,321 B1 1/2004 York
6,759,980 B2 * 7/2004 Chen et al. ..... 342/372
6,954,118 B2 * 10/2005 Kozyrev et al. ..... 333/161
6,987,488 B1 * 1/2006 Chang et al. ..... 343/767
7,276,993 B2 10/2007 York
2002/0014932 A1 * 2/2002 Osadchy et al. ..... 333/161
2002/0034667 A1 * 3/2002 Sengupta ..... 428/702
2003/0038748 A1 * 2/2003 Henderson et al. ..... 342/373
2004/0259316 A1 12/2004 Acikel et al.

OTHER PUBLICATIONS

Acikel, B. et al., "A New High Performance Phase Shifter Using $Ba_xSr_{1-x}TiO_3$ Thin Films, "IEEE Microwave and Wireless Components Letters, Jul. 2002, pp. 237-239, vol. 12, No. 7.

(Continued)

*Primary Examiner*—Tho G Phan
(74) *Attorney, Agent, or Firm*—Fenwick & West LLP

(57) ABSTRACT

A wafer antenna comprises a wafer substrate, a plurality of antenna elements integrated on the wafer substrate for radiating and receiving a radio frequency signal, an electrical connection integrated on the wafer substrate; a feed network integrated on the wafer substrate for distributing the RF signal from the electrical connection to the antenna elements and from the antenna elements to the electrical connection, and a plurality of tunable dielectric phase shifters integrated on the wafer substrate with each of the tunable dielectric phase shifters coupled to a corresponding one of the antenna elements and controlling the phase of the RF signal coupled to the corresponding one of the antenna elements.

16 Claims, 7 Drawing Sheets

OTHER PUBLICATIONS

Hayashi, H. et al., "An MMIC Active Phase Shifter Using a Variable Resonant Circuit," IEEE Transactions on Microwave Theory and Techniques, Oct. 1999, pp. 2021-2206, vol. 47, No. 10.

Hodges, N. et al., "A Precise Analog Phase Shifter for SHF SATCOM Phased Arrays," IEEE, GaAs IC Symposium, 1992, pp. 29-32.

Kim, D. et al., "2.4 GHz Continuously Variable Ferroelectric Phase Shifters Using All-Pass Networks," IEEE Microwave and Wireless Components Letter, Oct. 2003, pp. 434-436, vol. 13, No. 10.

Kim, D. et al, "S-Band Ferroelectric Phase Shifters with Continuous 180° and 360° Phase Shift Range," 4 pages.

Kim, D. et al., "Tunable $Ba_xSr_{1-x}TiO_3$ Interdigital Capacitors For Microwave Applications," 4 pages.

Liu, Y. et al., "$BaSrTiO_3$ Interdigitated Capacitors for Distributed Phase Shifter Applications," IEEE Microwave and Guided Wave Letters, Nov. 2000, pp. 448-450, vol. 10, No. 11.

Nath, J. et al., "Microwave Properties of BST Thin Film Interdigital Capacitors on Low Cost Alumina Substrates," $34^{th}$ European Microwave Conference, Amsterdam, 2004, pp. 1497-1500.

Viveiros, D. et al., "A Tunable All-Pass MMIC Active Phase Shifter," IEEE Transactions on Microwave Theory and Techniques, Aug. 2002, pp. 1885-1889, vol. 50, No. 8.

Yoon, Y.K. et al., "A Reduced Intermodulation Distortion Tunable Ferroelectric Capacitor: Architecture and Demonstration," IEEE Transactions on Microwave Theory and Techniques, Dec. 2003, pp. 2568-2576, vol. 51, No. 12.

York, R.A. et al., "Thin-Film Phase Shifters for Low-Cost Phased Arrays," URSI Conference, 2000, 10 pages.

Kim, D. et al, "S-Band Ferroelectric Phase Shifters with Continuous 180° and 360° Phase Shift Range," in 2002 Asia Pacific Microwave Symp. Dig., Nov. 18-20, 2002, 4 Pages.

Kim, D. et al., "Tunable $Ba_xSr_{1-x}TiO_3$ Interdigital Capacitors for Microwave Applications," in Proc. 2003 Asia-Pacific Microwave Conf., Nov. 4-7, 2003, 4 Pages, Seoul, South Korea.

* cited by examiner

WAFER SCANNING ANTENNA WITH INTEGRATED TUNABLE DIELECTRIC PHASE SHIFTERS

CROSS-REFERENCE TO RELATED APPLICATION

This applications claims priority under 35 U.S.C. § 119(e) from co-pending U.S. Provisional Patent Application No. 60/809,525, entitled "Wafer Antenna with Integrated Barium Strontium Titanate Phase Shifter," filed on May 30, 2006, which is incorporated by reference herein in its entirety.

BACKGROUND OF THE INVENTION

1. Field of the Invention

The present invention generally relates to the field of antennas, and more specifically, to a wafer based scanning phased-array antenna.

2. Description of the Related Arts

A conventional wafer antenna is typically fabricated with radiating antenna elements laid out in a fan shape on a silicon germanium (SiGe) or gallium arsenide (GaAs) substrate. Active elements such as phase shifters that couple to the radiating antenna elements are typically soldered or bonded in as discrete components on a circuit board together with the antenna elements built on the SiGe or GaAs substrate.

As such, manufacturing such conventional wafer antenna is time intensive and costly. In addition, SiGe and GaAs based wafers are expensive to manufacture. Thus, there is a need for a wafer antenna that is more convenient and cost-effective to produce. Also, there is a need for a wafer antenna whose the radiation pattern may be more effectively and conveniently controlled.

SUMMARY OF THE INVENTION

Embodiments of the present invention include a wafer antenna integrated with tunable dielectric phase shifters. Each BST phase shifter is integrated with its corresponding antenna element and the RF feed network directly onto the substrate during the manufacturing process.

More specifically, the wafer antenna in one embodiment comprises a wafer substrate, a plurality of antenna elements integrated on the wafer substrate, an electrical connection integrated on the wafer substrate, a feed network integrated on the wafer substrate for distributing the RF signal from the electrical connection to the antenna elements and from the antenna elements to the electrical connection, and a plurality of tunable dielectric phase shifters integrated on the wafer substrate with the feed network, where each of the tunable dielectric phase shifters is coupled to a corresponding one or more of the antenna elements. Each of the tunable dielectric phase shifters controls a phase of the RF signal coupled to the corresponding one of the antenna elements. The tunable dielectric phase shifters include signal and ground connections on the same side of the wafer substrate on which the tunable dielectric phase shifters are integrated.

In one embodiment, the tunable dielectric phase shifter may be a BST phase shifter, where each BST phase shifter is comprised of a pair of coplanar striplines and one or more BST capacitors coupled between the pair of coplanar striplines. The phase shift induced by each of the BST phase shifters is adjusted by controlling a DC (direct current) bias voltage applied to the one or more BST capacitors to adjust a radiation pattern of the antenna element coupled to each of the BST phase shifters and of the overall antenna.

In one embodiment, the DC bias voltage is supplied to the BST capacitors through the antenna elements. In one embodiment, at least some of the BST capacitors are periodically disposed between the pair of coplanar striplines. Each of the BST capacitors is comprised of a pair of electrodes and a BST dielectric layer disposed between the pair of electrodes. A balun circuit may be coupled between a microstrip line of each of the antenna elements and the coplanar striplines of each of the BST phase shifters to interface between the microstrip line and the coplanar striplines. The wafer substrate may be sapphire, alumina, glass, silicon, quartz, fused quartz, or gallium arsenide.

The present invention has the advantage that the antenna elements, the phase shifters, RF input/output connection, the RF feed network, and the DC biasing section are all fabricated integrated on the wafer using a thin-film BST process, making the manufacturing of the wafer antenna very convenient and cost-effective, with no need to solder or join discrete components to the wafer antenna. The use of less expensive wafers such as glass or sapphire saves on manufacturing costs for the wafer antenna. The phase shifts in the wafer antenna can be conveniently controlled simply by adjusting the DC bias voltages applied to the BST varactors (capacitors) in the phase shifters coupled to each of the antenna elements on the wafer antenna.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the embodiments of the present invention can be readily understood by considering the following detailed description in conjunction with the accompanying drawings.

DETAILED DESCRIPTION OF EMBODIMENTS

Figure 1:
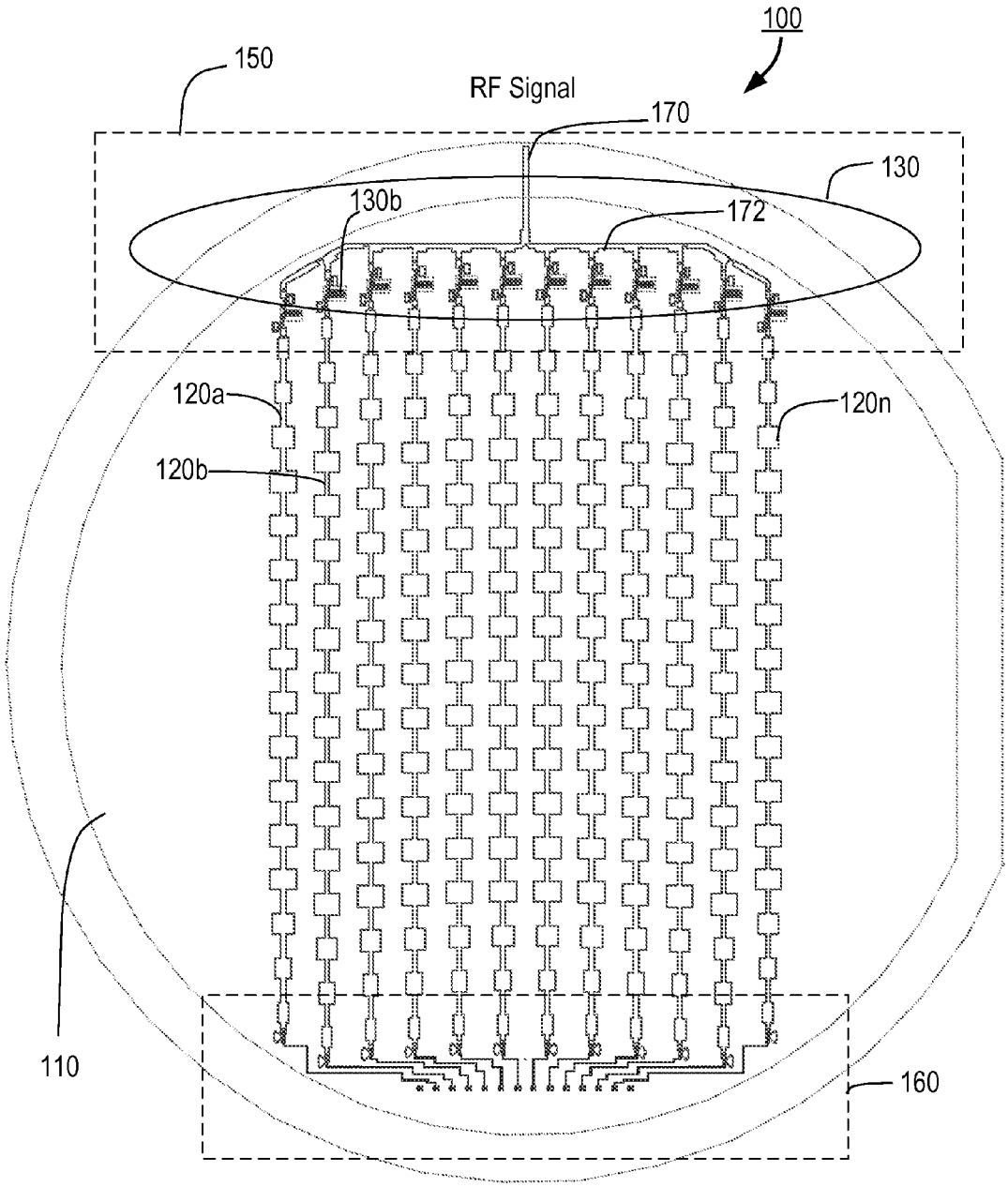
FIG. 1 illustrates a wafer antenna with integrated barium strontium titanate (BST) phase shifters, according to one embodiment of the present invention.

The Figures (FIG.) and the following description relate to preferred embodiments of the present invention by way of illustration only. It should be noted that from the following discussion, alternative embodiments of the structures and methods disclosed herein will be readily recognized as viable alternatives that may be employed without departing from the principles of the claimed invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

Figure (FIG.) 1 illustrates a wafer antenna 100 with integrated barium strontium titanate (BST) phase shifters, according to one embodiment of the present invention. The wafer antenna 100 includes a wafer 110, a plurality of antenna elements 120*a*, 120*b*, . . . , 120*n* (generally 120), phase shifters 130, a DC biasing section 160, RF input/output electrical connection 170, and an RF feed network 172. Each phase shifter is coupled to an antenna element, for example the phase shifter 130*b* is connected to the antenna element 120*b*. In other embodiments, each phase shifter may be coupled to more than one antenna element. The antenna elements 120*a*, 120*b*, . . . , 120*n* are metal elements that radiate or receive radio frequency (RF) signals, and in combination form a scanning, phased array antenna. The RF signals are input or output at the single RF input/output connection 170. The RF feed network 172 distributes the RF signal to be transmitted from the RF input/output connection 170 to the antenna elements 120*a*, 120*b*, 1120*n*, and delivers the received RF signal from the antenna elements 120*a*, 120*b*, 120*n* to the RF input/output connection 170.

As will be explained below, each of the phase shifters include tunable dielectric capacitors (e.g., BST varactors) whose capacitances may be independently controlled by the DC biasing section 160 such that the phase shifts induced by each of the phase shifters corresponding to each antenna element may be different. As a result, the antenna elements 120*a*, 120*b*, . . . , 120*n* radiate and receive RF signals with different radiation/reception patterns. Such differences in the radiation/reception patterns in each antenna element affect the constructive or destructive interferences between the radiation/reception pattern of each antenna element to shape the overall radiation/reception pattern of the wafer antenna 100. The radiation and reception patterns of the wafer antenna 100 can be adjusted by adjusting the phase shifts induced by each of the phase shifters 130. As will be explained below, the phase shifts induced by the phase shifters 130 may be controlled by adjusting the DC bias voltage applied to the tunable dielectric capacitors included in the phase shifters 130.

Note that the RF input/output connection 170, the RF feed network 172, the antenna elements, 120*a*, 120*b*, . . . , 120*n*, the phase shifters 130, and the DC biasing section 160 are all fabricated integrated on the wafer 110. As will be explained below, the phase shifters 130 are fabricated integrated with the RF feed network 172 on the edge of the antenna array away from the radiating elements 120*a*, 120*b*, . . . , 120*n*, using a thin-film BST process. Since the RF feed network 172 itself is integrated on the wafer 110, the wafer antenna requires merely one RF input/output connection 170. This makes the manufacturing of the wafer antenna 100 very convenient and cost-effective, since there is no need to solder or join discrete components to the wafer antenna. The wafer 110 is comprised of a relatively inexpensive substrate, for example, sapphire, alumina, glass, silicon, quartz, fused quartz, or gallium arsenide.

Figure 2:
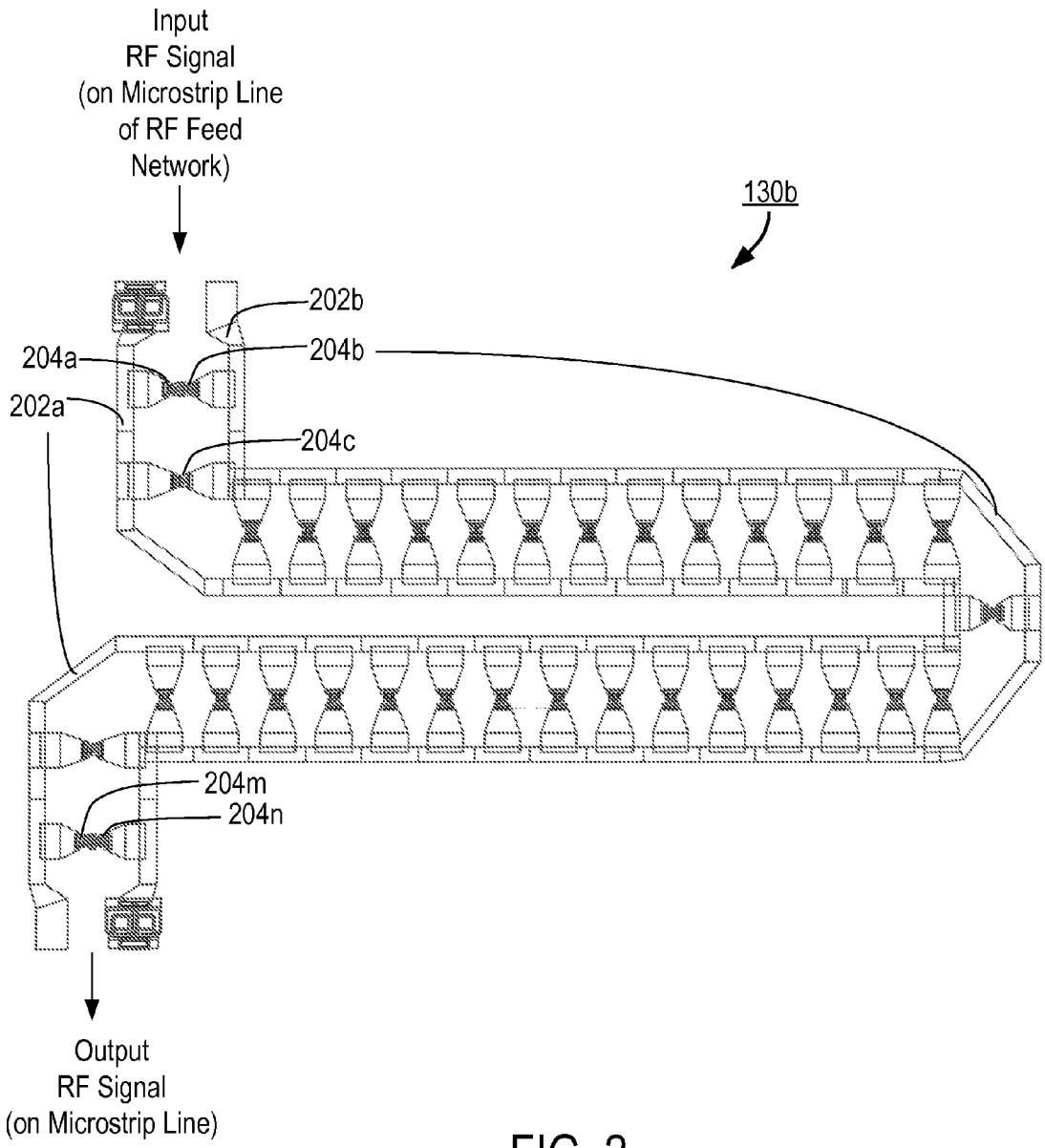
FIG. 2 illustrates a BST phase shifter used in the wafer antenna of FIG. 1, according to one embodiment of the present invention.

FIG. 2 illustrates a tunable dielectric (e.g., BST) phase shifter 130*b* used in the wafer antenna of FIG. 1, according to one embodiment of the present invention. The BST phase shifters 130 on the wafer antenna 100 have substantially the same structures as illustrated in FIG. 2. The BST phase shifter 130*b* includes tunable dielectric (e.g., BST) capacitors (varactors) (e.g., 204*a*, 204*b*, 204*c*, . . . , 204*m*, 204*n*) coupled between coplanar striplines 202*a*, 202*b*. As is illustrated in FIG. 2, a number of BST varactors (e.g., 204*a*, 204*b*, 204*c*, . . . , 204*m*, 204*n*) are loaded between the coplanar striplines 202*a*, 202*b*. The total phase shift induced by the BST phase shifter 130*b* is dependent upon the capacitance of these BST varactors (e.g., 204*a*, 204*b*, 204*c*, . . . , 204*m*, 204*n*). As will be explained below, the capacitances of the BST varactors (e.g., 204*a*, 204*b*, 204*c*, . . . , 204*m*, 204*n*) may be controlled by adjusting the DC bias voltage applied to the BST varactors. The input RF signal entering the microstrip lines passes through the coplanar striplines of the phase shifter 130*b* with its phase changed and is output again to microstrip line. Note that the entering point of the phase shifter 130*b* includes two BST varactors 204*a*, 204*b* coupled between the coplanar striplines 202*a*, 202*b*, and the ending point of the phase shifter 130*b* also includes two varactors 204*m*, 204*n* coupled between the coplanar striplines 202*a*, 202*b*. The remaining sections of the phase shifter 130*b* include a series of single BST varactors 204*c* coupled between the coplanar striplines 202*a*, 202*b*.

The phase shifters 130 are not limited to BST phase shifters, but can be any type of tunable dielectric phase shifter including any type of tunable capacitor with tunable dielectric allowing its capacitance to be tuned. In addition, the phase shifters 130 are not limited to the particular structure of the BST phase shifter 130*b* shown in FIG. 2. For additional examples and descriptions of phase shifters based on transmission lines periodically loaded by capacitors, see U.S. Pat. No. 6,559,737 issued on May 6, 2003 to Amit S. Nagra and Robert A. York, entitled "Phase Shifters Using Transmission Lines Periodically Loaded with Barium Strontium Titanate (BST) Capacitors," which is incorporated by reference herein. Another example of a BST phase shifter that can be used with the wafer antenna 100 can be found in U.S. patent application Ser. No. 11/288,723, filed by Robert A. York on Nov. 28, 2005, entitled "Analog Phase Shifter Using Cascaded Voltage Tunable Capacitor", which is incorporated by reference herein.

Figure 3A:
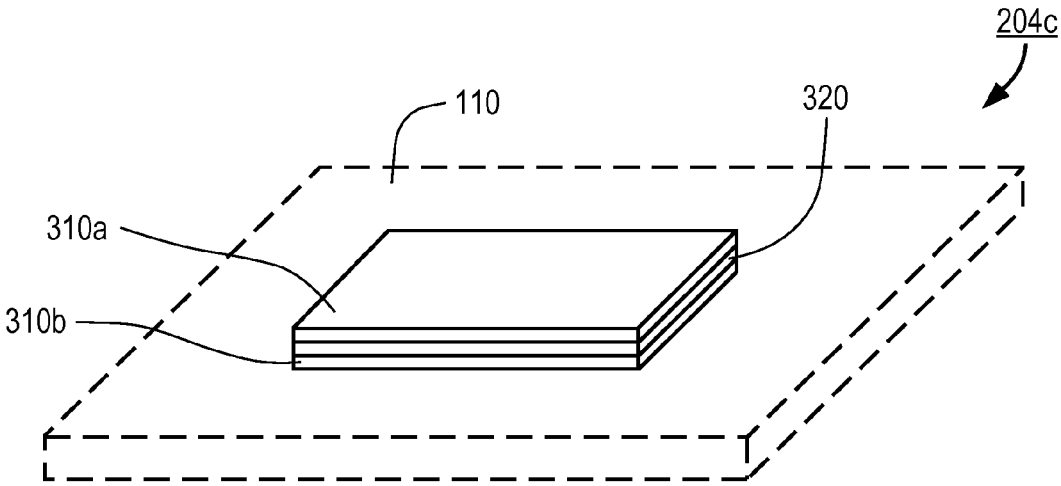
FIG. 3A illustrates a BST capacitor used in the BST phase shifter of FIG. 2, according to one embodiment of the present invention.

FIG. 3A illustrates a BST capacitor 204*c* used in the BST phase shifter 130*b* of FIG. 2, according to one embodiment of the present invention. The BST capacitor 204*c* has a typical metal-insulator-metal (MIM) parallel plate configuration of a thin film capacitor. The BST capacitor 204*c* is formed as a vertical stack comprised of a metal base electrode 310*b* supported by the substrate 110, a BST dielectric layer 320, and a metal top electrode 310*a*. The lateral dimensions, along with the dielectric constant and thickness of the dielectric 320, determine the capacitance value of the BST varactor 320.

Materials in the barium strontium titanate (BST) family have characteristics that are well suited for use as the dielectric 320. BST generally has a high dielectric constant so that large capacitances can be realized in a relatively small area. Furthermore, BST has a permittivity that depends on the applied electric field. In other words, thin-film BST has the remarkable property that the dielectric constant can be changed appreciably by an applied DC-field, allowing for very simple voltage-variable capacitors (varactors), with the added flexibility that their capacitance can be tuned by changing the DC bias voltage across the capacitor. In addition, the DC bias voltage typically can be applied in either direction across a BST capacitor since the film permittivity is generally symmetric about zero bias. That is, BST typically does not exhibit a preferred direction for the electric field. One further advantage is that the electrical currents that flow through BST capacitors are relatively small compared to other types of semiconductor varactors. Although BST is used as the tunable dielectric herein, other types of tunable dielectric may be used to implement the phase shifters 130.

Figure 3B:
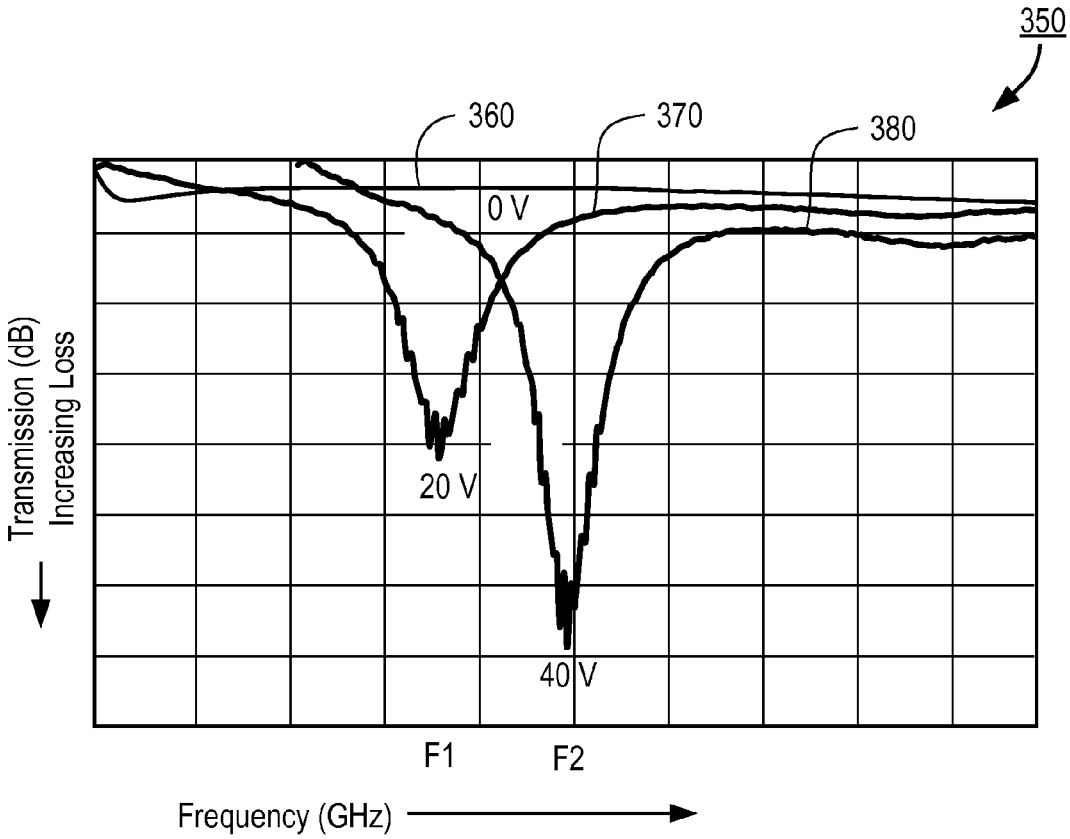
FIG. 3B is a graph illustrating RF transmission measurements of the BST capacitor of FIG. 3A as a function of the frequency of an RF signal.

FIG. 3B is a graph illustrating RF transmission measurements of the BST capacitor 204*c* of FIG. 3A as a function of the frequency of an RF signal. Three curves 360, 370, 380 are shown, corresponding to different applied DC voltages. At zero applied DC voltage, curve 360 shows a well-behaved flat response with no significant transmission loss. In contrast, at an applied DC voltage of 20 V, curve 370 shows a large resonance and transmission loss appearing at a specific resonant frequency F1 GHz. At an applied DC voltage of 40V, curve 380 shows a larger resonance and transmission loss appearing at the resonant frequency F2 GHz which is higher than F1 GHz. Thus, at a particular RF frequency, the capacitance of the BST varactor 204*c* can be adjusted by controlling the DC bias voltage applied to it.

Figure 4A:
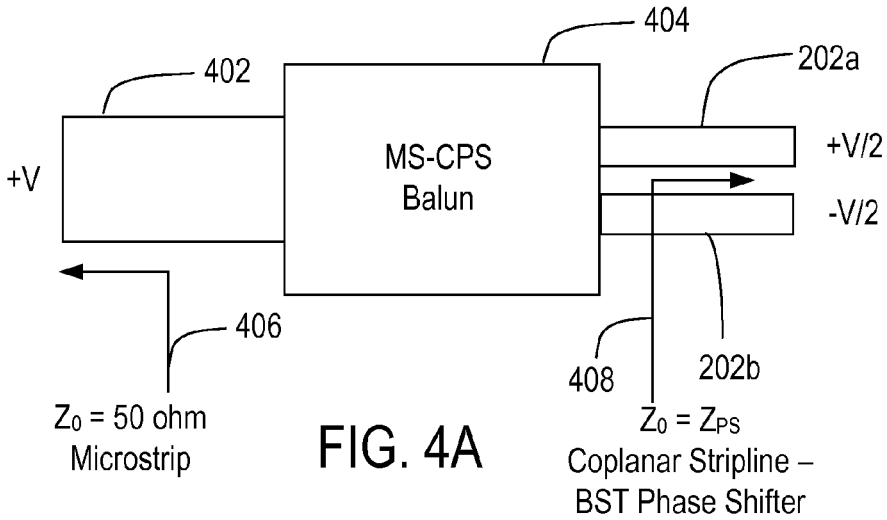
FIGS. 4A, 4B, and 4C illustrate a balun circuit for interfacing between a microstrip line and coplanar striplines used in the wafer antenna of FIG. 1, according to one embodiment of the present invention.
Figure 4B:
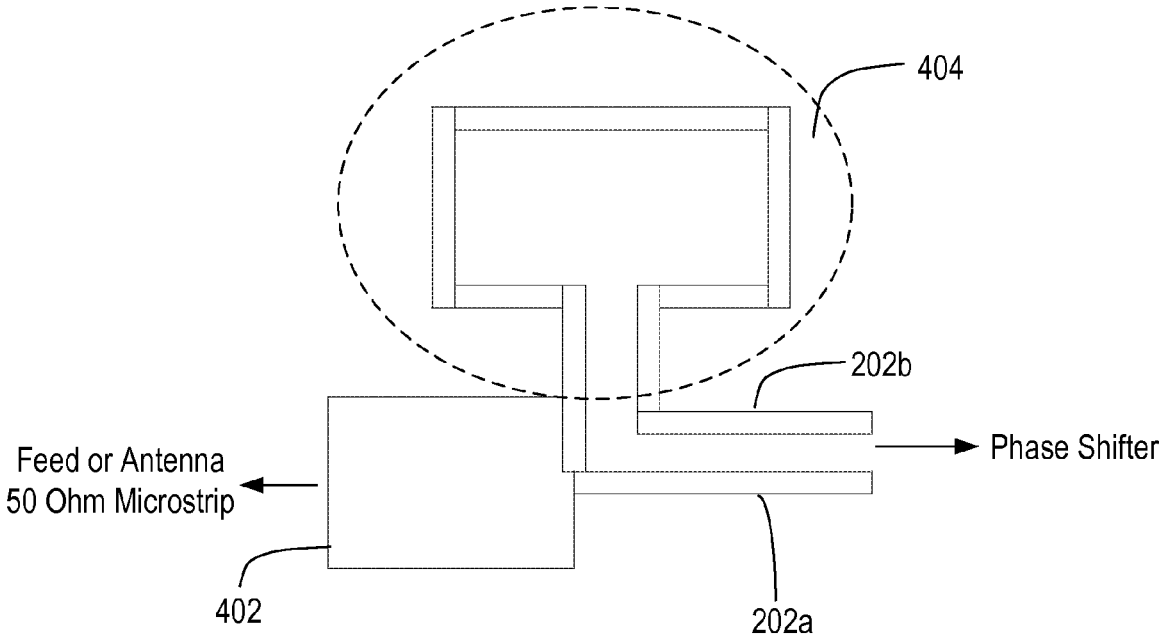
Figure 4C:
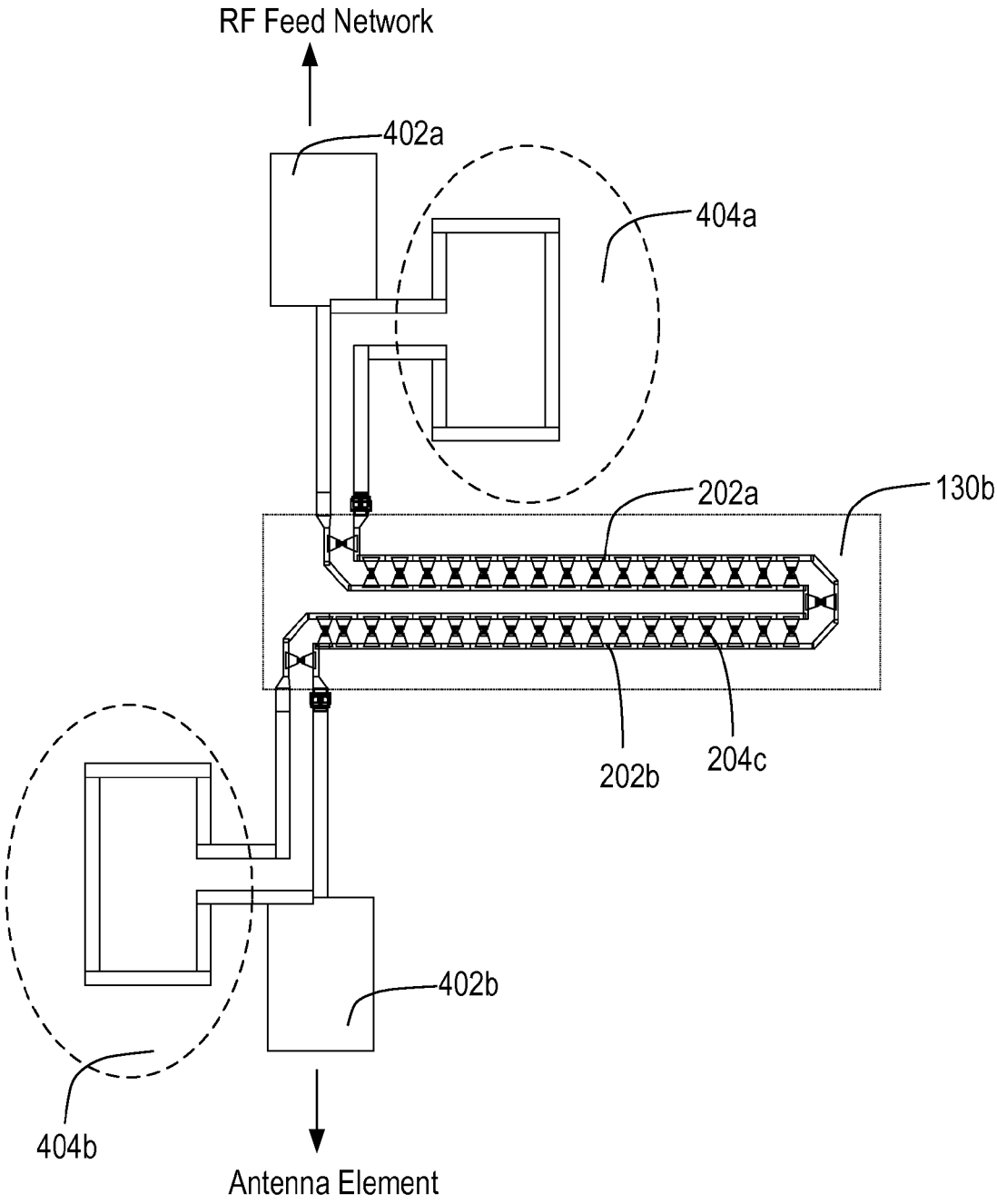

FIGS. 4A, 4B, and 4C illustrate a balun circuit for interfacing between a microstrip line and coplanar striplines used in the wafer antenna of FIG. 1, according to one embodiment of the present invention. A balun circuit is generally used to link a symmetrical (balanced) circuit to an asymmetrical (unbalanced) circuit. Here, the balun circuit 404 is used to interface between the microstrip (MS) lines 402 of the RF feed network 172 or the antenna elements 120*a*, 120*b*, . . . , 120*n* and the coplanar striplines (CPS) 202*a*, 202*b* of the phase shifters 130 (e.g., 130*b*). For each antenna element 120*a*, 120*b*, . . . , 120*n*, the output impedance ($Z_0$) 406 toward the microstrip line 402 may be, for example, 50 ohm, and the output impedance ($Z_0$) 408 toward the coplanar strip lines 202*a*, 202*b* may be approximately equal to the input impedance ($Z_{PS}$) of the BST phase shifter (e.g., 130*b*). The balun circuit 404 provides the appropriate impedance matching between the microstrip line 402 and the coplanar striplines 202*a*, 202*b*. In addition, the use of the balun circuit 404 obviates the use of ground vias in the wafer antenna 100.

The shape of the balun circuit 404 is shown in more detail in FIG. 4B. The balun circuit 404 is comprised of the coplanar strip lines 202*a*, 202*b* configured in a unique shape as shown in FIG. 4B to facilitate the interfacing and impedance matching between the microstrip line 402 (which could be on the antenna feed side or the antenna element side) and the coplanar striplines 202*a*, 202*b* toward the BST phase shifter (e.g., 130*b*). Referring to FIG. 4C, the balun circuit 404*a* is shown interfacing between the microstrip line 402*a* on the RF feed network side 172 and the BST phase shifter 130*b*, and the balun circuit 404*b* is shown interfacing between the microstrip line 402*b* on the antenna element side and the BST phase shifter 130*b*.

Figure 5:
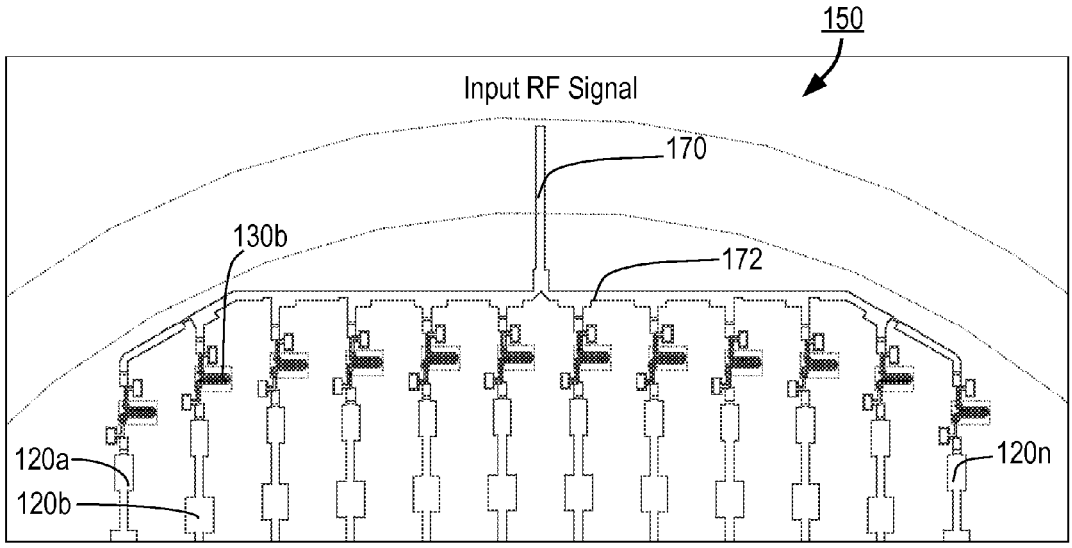
FIG. 5 is an enlarged view of the phase shifter section 150 on the wafer antenna of FIG. 1, according to one embodiment of the present invention.

FIG. 5 is an enlarged view of the phase shifter section 150 on the wafer antenna of FIG. 1, according to one embodiment of the present invention. The section 150 shows the input RF signal feed input to the RF input/output connection 172, split by the RF feed network 172, and passing through the phase shifters (e.g., 130*b*) to the antenna elements 120*a*, 120*b*, . . . , 120*n*. Received RF signals would propagate in the opposite direction.

Figure 6A:
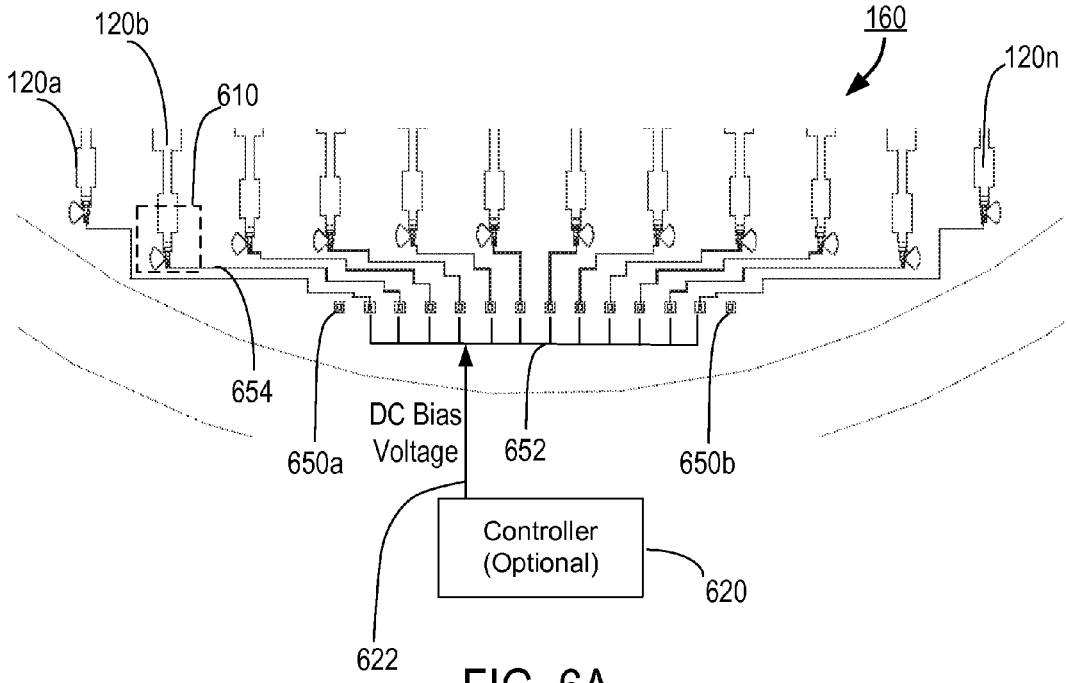
FIG. 6A is an enlarged view of the DC bias section 160 on the wafer antenna of FIG. 1.

FIG. 6A is an enlarged view of the DC bias section 160 on the wafer antenna of FIG. 1. As shown in FIG. 6A, the wafer antenna includes DC bias voltage pads 652 separately connected to each antenna element 120*a*, 120*b*, . . . , 120*n* through DC bias voltage lines 654, and ground pads 650*a*, 650*b*. The DC bias voltage pads/lines 652, 654 provide a separate DC bias voltage to each of the phase shifters 130 connected to the corresponding antenna elements 120*a*, 120*b*, . . . , 120*n*. Different DC voltages can be set and provided to each of the tunable dielectric phase shifters 130 to change the capacitances of the BST varactors 204*a*, 204*b*, . . . , 204*n* in the phase shifters 130. Since the capacitances of the BST varactors 204*a*, 204*b*, . . . , 204*n* in the phase shifters 130 change according to the applied DC bias voltage, the bias voltage pads/lines 652, 654 provide a simple and convenient way to change the phase shift of each of the phase shifters 130, the resulting radiation/reception pattern of each antenna element 120*a*, 120*b*, . . . , 120*n*, and the overall radiation/reception pattern of the wafer antenna 100. The DC biasing scheme for the phase shifters 130 as shown in FIG. 6A uses the antenna elements themselves 120*a*, 120*b*, . . . , 120*n* to bring in the DC bias voltage from the periphery of the wafer antenna 100 to the BST varactors 204*a*, 204*b*, . . . , 204*n* in the phase shifters 130, using the simple on-wafer bias voltage pads 652. This obviates the need for separate circuitry for providing DC bias voltage or ground connection to the phase shifters 130, and simplifies the circuitry of the wafer antenna 100. As can be seen from FIGS. 1, 2, 4C, 5, and 6, the phase shifters 130 are integrated on the wafer 110 with the RF feed network 172, with the signal connections and the DC bias voltage and ground connections on the same side of the wafer 110 on which the phase shifters 130 are integrated.

The controller 620 is an optional component and may be used to separately set and control the DC bias voltage provided to each of the bias voltage pads 652. The controller 620 may be implemented using control logic such as a microcontroller or microprocessor to execute instruction sets, or a state machine, or other signal control logic. The controller 620 may also be fabricated integrated to the wafer antenna 100, or may be connected to the wafer antenna 100 as a discrete component.

Figure 6B:
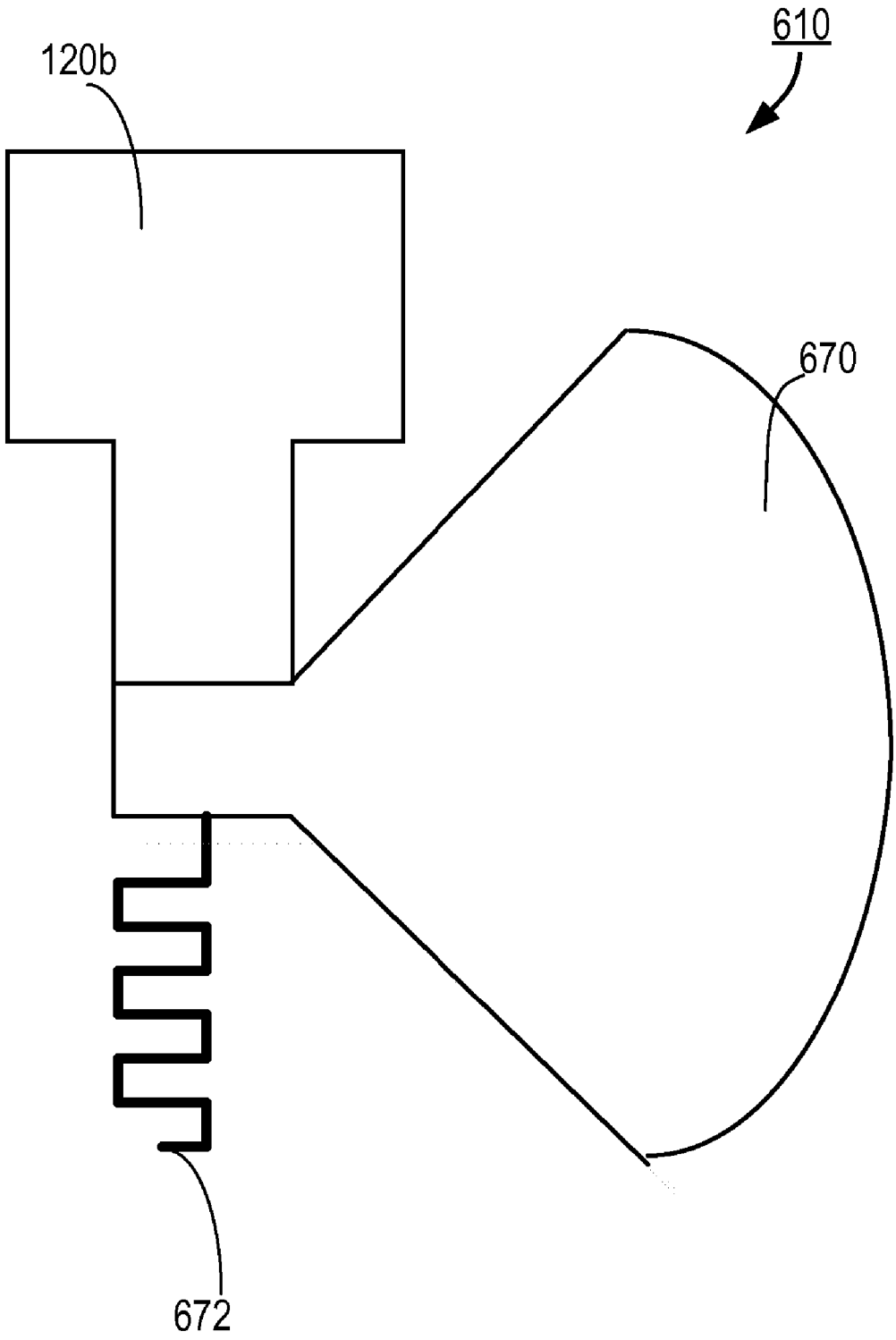
FIG. 6B is a further enlarged view of one DC bias section 610 for one antenna element of the wafer antenna of FIG. 1.

FIG. 6B is a further enlarged view of one DC bias section 610 for an antenna element of the wafer antenna of FIG. 1. Referring to FIGS. 6A and 6B, the DC bias section 610 includes the microstrip line of the antenna element 120*b* coupled to a radial stub 670 that facilitates radiation and reception of the RF signal from the antenna element 120*b*. As shown in FIG. 6B, the radial stub 670 has a fan shape, and is coupled to a DC control line 672. The DC control line 672 is a high impedance line and is coupled to the bias voltage pads 652 through the lines 654. The structure illustrated in FIG. 6B provides matched termination for the microstrip line of the antenna element 610*b* for preventing undesired radiation at the end of the microstrip line. The high impedance DC control line 672 provides good isolation between AC (Alternating Current) and DC (Direct Current).

The present invention includes a number of benefits and advantages. For example, because the RF input/output connection 170, the RF feed network 172, the antenna elements 120*a*, 120*b*, . . . , 120*b*, the phase shifters 130, and the DC biasing section 160 are all fabricated integrated on the wafer 110, manufacturing of the wafer antenna 100 is very convenient and cost-effective, with no need to solder or join discrete components to the wafer antenna. The use of less expensive wafers such as glass or sapphire saves on manufacturing costs. The phase shifts in the wafer antenna 100 can be conveniently controlled simply by adjusting the DC bias voltages applied to the BST varactors in the phase shifters coupled to each of the antenna elements on the wafer antenna.

Upon reading this disclosure, those of skill in the art will appreciate still additional alternative structural and functional designs for a scanning, phased-array wafer antenna with an integrated tunable dielectric phase shifter through the disclosed principles of the present invention. Thus, while particular embodiments and applications of the present invention have been illustrated and described, it is to be understood that the invention is not limited to the precise construction and components disclosed herein and that various modifications, changes and variations which will be apparent to those skilled in the art may be made in the arrangement, operation and details of the method and apparatus of the present invention disclosed herein without departing from the spirit and scope of the invention as defined in the appended claims.

What is claimed is:

1. An antenna comprising:

a wafer substrate;

a plurality of antenna elements integrated on the wafer substrate for radiating or receiving a radio frequency (RF) signal;

an electrical connection integrated on the wafer substrate;

a feed network integrated on the wafer substrate for distributing the RF signal from the electrical connection to the antenna elements and from the antenna elements to the electrical connection;

a plurality of tunable dielectric phase shifters integrated on the wafer substrate with the feed network, each of the tunable dielectric phase shifters coupled to a corresponding one or more of the antenna elements and controlling a phase of the RF signal coupled to said corresponding one or more of the antenna elements and including a pair of coplanar striplines and one or more barium strontium titanate (BST) capacitors coupled between the pair of coplanar striplines; and a balun circuit coupled between a microstrip line of one of the antenna elements and the coplanar striplines of one of the tunable dielectric phase shifters.

2. The antenna of claim 1, wherein the tunable dielectric phase shifters include signal and ground connections on a same side of the wafer substrate on which the tunable dielectric phase shifters are integrated.

3. The antenna of claim 1, wherein at least some of the BST capacitors are periodically disposed between the pair of coplanar striplines.

4. The antenna of claim 1, wherein each of the BST capacitors comprises:

a pair of electrodes; and a BST dielectric layer disposed between the pair of electrodes.

5. The antenna of claim 1, wherein the wafer substrate comprises one selected from the group consisting of sapphire, alumina, glass, silicon, quartz, fused quartz, and gallium arsenide.

6. An antenna comprising:

a wafer substrate;

a plurality of antenna elements integrated on the wafer substrate for radiating or receiving a radio frequency (RF) signal;

an electrical connection integrated on the wafer substrate;

a feed network integrated on the wafer substrate for distributing the RF signal from the electrical connection to the antenna elements and from the antenna elements to the electrical connection;

a plurality of tunable dielectric phase shifters integrated on the wafer substrate with the feed network, each of the tunable dielectric phase shifters coupled to a corresponding one or more of the antenna elements to control a phase of the RF signal coupled to said corresponding one or more of the antenna elements and including:

a pair of coplanar striplines; and one or more barium strontium titanate (BST) capacitors coupled between the pair of coplanar striplines, and wherein a phase shift induced by each of the tunable dielectric phase shifters is adjusted by controlling a DC (direct current) bias voltage applied to the one or more BST capacitors to adjust a radiation pattern of the antenna; and a balun circuit coupled between a microstrip line of one of the antenna elements and the coplanar striplines of one of the tunable dielectric phase shifters.

7. The antenna of claim 6, wherein the tunable dielectric phase shifters include signal and ground connections on a same side of the wafer substrate on which the tunable dielectric phase shifters are integrated.

8. The antenna of claim 6, wherein the DC bias voltage is supplied to the BST capacitors through the antenna elements.

9. The antenna of claim 6, wherein the DC bias voltage is controlled by a digital controller coupled to the antenna.

10. The antenna of claim 6, wherein at least some of the BST capacitors are periodically disposed between the pair of coplanar striplines.

11. The antenna of claim 6, wherein each of the BST capacitors comprises:

a pair of electrodes; and a BST dielectric layer disposed between the pair of electrodes.

12. The antenna of claim 6, wherein the wafer substrate comprises one selected from the group consisting of sapphire, alumina, glass, silicon, quartz, fused quartz, and gallium arsenide.

13. An antenna comprising:

a wafer substrate;

a plurality of antenna elements integrated on the wafer substrate, each of the antenna elements including a microstrip line for radiating or receiving a radio frequency (RF) signal;

an electrical connection integrated on the wafer substrate;

a feed network integrated on the wafer substrate for distributing the RF signal from the electrical connection to the antenna elements and from the antenna elements to the electrical connection;

a plurality of barium strontium titanate (BST) phase shifters integrated on the wafer substrate with the feed network, each of the BST phase shifters coupled to a corresponding one or more of the antenna elements and including:

a pair of coplanar striplines; and one or more BST capacitors coupled between the pair of coplanar striplines, and wherein a phase shift induced by each of the BST phase shifters is adjusted by controlling a DC (direct current) bias voltage applied to the one or more BST capacitors to adjust a radiation pattern of the antenna; and one or more balun circuits coupled between the microstrip line of each of the antenna elements and the coplanar striplines of each corresponding one of the BST phase shifters.

14. The antenna of claim 13, wherein the BST phase shifters include signal and ground connections on a same side of the wafer substrate on which the BST phase shifters are integrated.

15. The antenna of claim 13, wherein the DC bias voltage is supplied to the BST capacitors through the antenna elements.

16. The antenna of claim 13, wherein a first DC bias voltage is applied to a first BST phase shifter coupled to a first antenna element and a second DC bias voltage different from the first DC bias voltage is applied to a second BST phase shifter coupled to a second antenna element.

* * * * *